United States Patent [19]

Tanaka et al.

[11] Patent Number: 4,847,550

[45] Date of Patent: Jul. 11, 1989

[54] SEMICONDUCTOR CIRCUIT

[75] Inventors: Satoshi Tanaka, Kokubunji; Hirotoshi Tanaka, Yamanashi; Taizo Kinoshita; Nobuo Kotera, both of Kokubunji; Minoru Nagata, Kodaira; Kiichi Yamashita, Kanagawa; Tomoyuki Watanabe, Hachioji, all of Japan

[73] Assignee: Hitachi, Ltd., Tokyo, Japan

[21] Appl. No.: 143,802

[22] Filed: Jan. 14, 1988

[30] Foreign Application Priority Data

Jan. 16, 1987 [JP] Japan ..... 62-5984

[51] Int. Cl.[4] ..... G05F 3/20

[52] U.S. Cl. ..... 323/313

[58] Field of Search ..... 323/312, 313, 314, 315, 323/316, 907

[56] References Cited

U.S. PATENT DOCUMENTS

| | | | |
|---|---|---|---|
| 4,008,406 | 2/1977 | Kawagoe | 323/313 X |
| 4,031,456 | 6/1977 | Shimada et al. | 323/315 |
| 4,618,816 | 10/1986 | Monticelli | 323/312 X |
| 4,645,998 | 2/1987 | Shinohara et al. | 323/313 |
| 4,686,451 | 8/1987 | Li et al. | 323/907 X |
| 4,717,685 | 1/1988 | Nakajima | 437/22 X |

FOREIGN PATENT DOCUMENTS

| | | |
|---|---|---|
| 0029231 | 5/1981 | European Pat. Off. . |
| 0076963 | 7/1984 | European Pat. Off. . |
| 5043870 | 4/1975 | Japan . |

OTHER PUBLICATIONS

Wiley et al., "Analysis and Design of Analog Integrated Circuit", MOS Amplifier Design, 1984, pp. 709–718.

Baitinger et al., "Constant Current Source Network", IBM Technical Disclosure, 2/71, pp. 2516.

*Primary Examiner*—Patrick R. Salce

*Assistant Examiner*—Kristine Peckman

*Attorney, Agent, or Firm*—Antonelli, Terry & Wands

[57] ABSTRACT

A constant voltage circuit according to this invention comprises first means attenuating or dividing fluctuating voltage and an amplifying FET, to the gate of which the output attenuated or divided by the first means is applied and whose drain is connected with the fluctuating voltage through load means. The attenuation ratio or division ratio of the first means, the mutual conductance of the amplifying FET and the impedance of the load means are so set that the voltage drop across the load means cancels the fluctuating amount of the fluctuating voltage. Consequently an output voltage, which is maintained substantially constant, is obtained at the drain of the amplifying FET, independently of fluctuations in the fluctuating voltage, and thus a constant voltage circuit can be obtained. A constant current circuit according to this invention utilizes the constant voltage circuit described above. The output voltage of the constant voltage circuit is supplied to the gate of the constant current FET. Consequently a current, which is maintained substantially constant, flows through the drain-source path of this constant current FET and thus a constant current circuit can be obtained.

4 Claims, 5 Drawing Sheets

EXAMPLE OF VOLTAGE CONVERTING CIRCUIT $$I_{OUT} = \frac{I_{IN}}{m^2 (m+1)}$$

SEMICONDUCTOR CIRCUIT

BACKGROUND OF THE INVENTION

1. Field of the Invention

This invention relates to a semiconductor circuit, and in particular to a constant voltage circuit and a constant current circuit, which are suitable for integrated circuits using field effect transistors.

2. Description of the Prior Art

Heretofore a current mirror type current source using FETs is discussed in "Analysis and Design of Analog Integrated Circuit", Second Edition (1984), John Wiley & Sons, Inc. pp 709–718 (in particular, cf. p. 710 FIG. 12.5 etc.).

SUMMARY OF THE INVENTION

In a standard current mirror circuit according to the prior art technique described above no attention is paid to fluctuations in the power supply voltage and the temperature or fluctuations of elements such as fluctuations in the threshold voltage, etc. when field effect transistors are used. Therefore there was a problem that current varied due to fluctuations in the power supply voltage and the temperature and fluctuations of elements.

Consequently an object of this invention is to provide a constant voltage circuit or a constant current circuit, which is not influenced by fluctuations in the power supply voltage or the temperature and more preferably which is not influenced by fluctuations of elements.

Other objects and new features of this invention will be obvious from the following description.

A constant voltage circuit according to this invention comprises first means attenuating or dividing fluctuating voltage and an amplifying FET, to the gate of which the output attenuated or divided by the first means is applied and whose drain is connected with the fluctuating voltage through load means. The attenuation or division ratio of the first means, the mutual conductance of the amplifying FET and the impedance of the load means are so set that the voltage drop across the load means cancels the fluctuating amount of the fluctuating voltage. Consequently an output voltage, which is maintained substantially constant, is obtained at the drain of the amplifying FET, independently of fluctuations in the fluctuating voltage, and thus a constant voltage circuit can be obtained.

A constant current circuit according to this invention utilizes the constant voltage circuit described above. The output voltage of the constant voltage circuit is supplied to the gate of the constant current FET. Consequently a current, which is maintained substantially constant, flows through the drain-source path of this constant current FET and thus a constant current circuit can be obtained.

As described above, since the element constants of the circuit elements constituting the constant voltage circuit are so set that fluctuations in the fluctuating voltage are cancelled, a constant voltage output can be obtained.

Further, since the constant current FET is biased by the constant voltage output, a constant current flows through the FET and thus a constant current circuit can be obtained.

DESCRIPTION OF THE PREFERRED EMBODIMENTS

Figure 1:
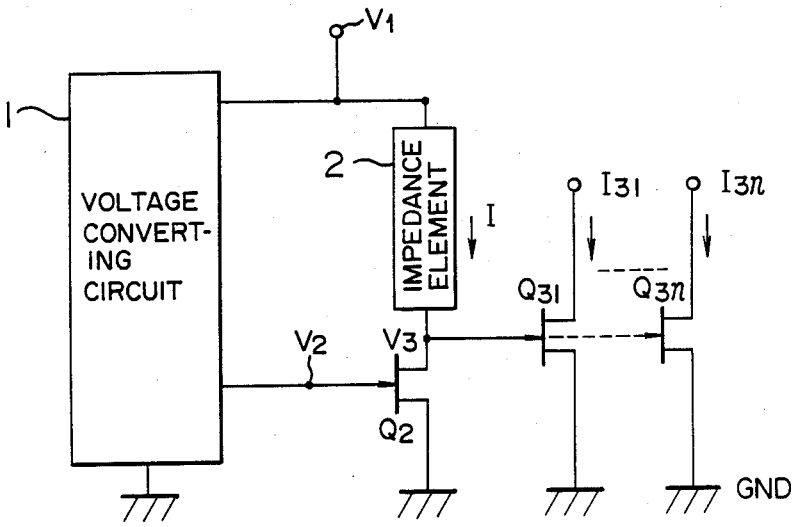
FIG. 1 shows a circuit diagram representing a constant voltage circuit and constant current circuit according to a basic embodiment of this invention.

FIG. 1 shows a circuit diagram representing a constant voltage circuit and a constant current circuit according to a basic embodiment of this invention. A voltage converting circuit 1 acts as first means generating a converted control voltage $V_2$ by attenuating or dividing fluctuating voltage $V_1$. The converted control voltage $V_2$ is applied to the gate of an N-channel amplifying FET $Q_2$ and the drain of the FET $Q_2$ is connected with a fluctuating power source $V_1$ through an impedance element 2 serving as load means. Further the source of the FET $Q_2$ is connected with the ground potential GND. The attenuation or division ratio of the voltage converting circuit 1, the mutual conductance of the amplifying FET $Q_2$ and the impedance of the impedance element 2 are so set that the voltage drop across the impedance element 2 cancels the fluctuating amount of the fluctuating voltage $V_2$.

Consequently $V_2$ increases with increasing $V_1$; the current I flowing through the impedance element 2 increases; the voltage drop across the impedance element 2 increases; and thus the output voltage $V_3$ is maintained constant. When $V_1$ decreases, inverse phenomena occur. For the same reason $V_3$ is maintained constant and thus it is possible to obtain the constant voltage output $V_3$. The constant voltage output $V_3$ obtained in this way is applied to the gates of constant current FETs $Q_{31}$–$Q_{3n}$. Each of the constant currents $I_{31}$–$I_{3n}$ flows through the drain-source path of each of these constant current FETs $Q_{31}$–$Q_{3n}$, respectively.

The constant voltage operation and the constant current operation described above will be analyzed below, by using some equations.

The relation between the input voltage $V_1$ and the control voltage $V_0$ of the voltage converting circuit 1 can be represented by the following equation;

$$V_2 = f(V_1) \tag{1}$$

On the other hand the current I flowing through the impedance element 2 is given by the following equation;

$$I = g(V_1 - V_3) \tag{2}$$

At the same time this current I is the drain current for the amplifying FET $Q_2$, which is given by the following equation;

$$I = K_2(V_2 - V_{TH2})^2 \tag{3}$$

where $V_{TH2}$ and $K_2$ represent the threshold voltage and the mutual conductance of the FET $Q_2$, respectively.

Transforming Eq. (2) stated above, the following equation can be obtained;

$$V_1 - V_3 = g^{-1}(I) \tag{4}$$

Substituting the right member of Eq. (3) for I in Eq. (4), the following equation is obtained.

$$V_1 - V_3 = g^{-1}\{K_2 \cdot (f(V_1) - V_{TH2})^2\} \tag{5}$$

Consequently the functions f and g as well as $K_2$ and $V_{TH2}$ are so set that the following equation (6) is satisfied;

$$g^{-1}\{K_2 \cdot (f(V_1) - V_{TH2})^2\} = V_1 - \alpha \tag{6}$$

where $\alpha$ is a constant.

Transforming Eqs. (5) and (6), the following equation is obtained;

$$V_3 = V_1 - (V_1 - \alpha) = \alpha \tag{7}$$

In this way it is possible to set the output voltage $V_3$ at a constant value, which is substantially independent of the fluctuating voltge $V_1$. When the constant voltage $V_3 = \alpha$ is applied to the gates of the constant currents FETs $Q_{31} - Q_{3n}$, the threshold voltage and the mutual conductance of the FET $Q_{31}$ being $V_{TH31}$ and $K_{31}$, respectively, the current $I_{31}$ flowing through the drain-source path of the FET $Q_{31}$ is given by the following equation;

$$I_{31} = K_{31}(\alpha - V_{TH31})^2 \tag{8}$$

On the other hand, when Eq. (7) satisfies $$V_3 = \alpha \approx V_{TH31} + \beta \tag{9}$$

where $\beta$ is a constant physical quantity, which depends hardly on fabrication fluctuations, variations in the temperature, etc., Eq. (8) is given by $$I_{31} = K_{31}\beta^2 \tag{10}$$

and thus it is possible to realize a constant current source, which is not influenced by fabrication fluctuations, variations in the temperature and variations in the voltage $V_1$.

Hereinbelow the meaning of f, g, $\alpha$ and $\beta$ and how to choose them will be explained more in detail by using concrete embodiments.

Figure 2:
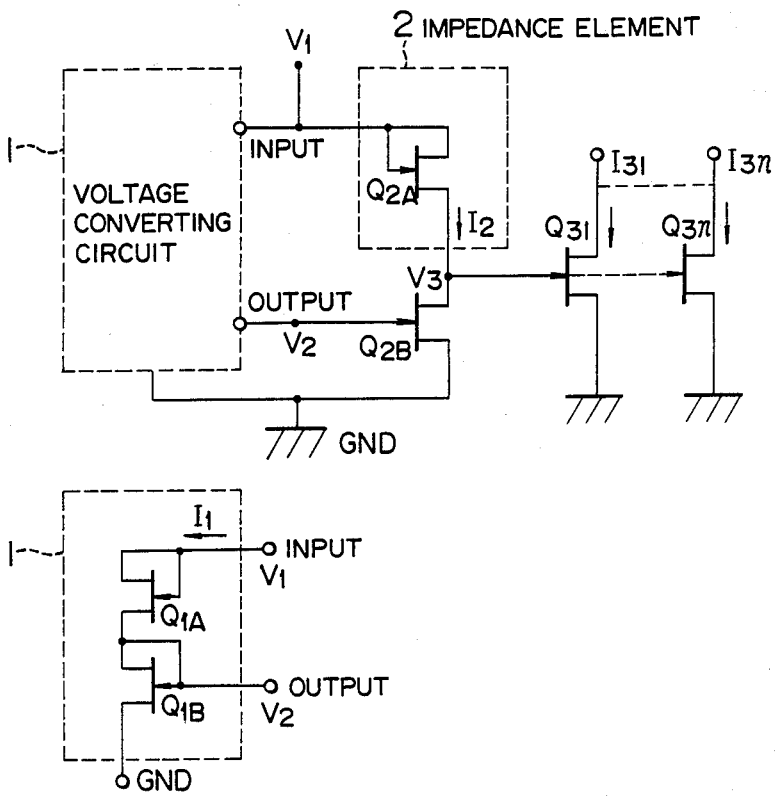
FIG. 2 shows a circuit diagram representing a constant voltage circuit and a constant current circuit according to a concrete embodiment of this invention.

FIG. 2 shows a circuit diagram representing a constant voltage circuit and a constant current circuit according to a concrete embodiment of this invention. The embodiment differs from that represented by FIG. 1 in that the voltage converting circuit 1 is constituted by FETs $Q_{1A}$ and $Q_{1B}$ connected in series, whose drain and gate are short-circuited and that the impedance element 2 is constituted by an FET $Q_{2A}$, whose drain and gate are similarly short-circuited. Representing the gate-source voltage, the threshold voltage and the mutual conductance of the FETs $Q_{1A}$, $Q_{1B}$, $Q_{2A}$, $Q_{2B}$, $Q_{31}$ and $Q_{3n}$ by $V_{gs1A}$, $V_{gs1B}$, $V_{gs2A}$, $V_{gs2B}$, $V_{gs31}$, $V_{gs3n}$; $V_{th1A}$, $V_{th1B}$, $V_{th2A}$, $V_{th2B}$, $V_{th31}$, $V_{th3n}$; $K_{1A}$, $K_{1B}$, $K_{2A}$, $K_{2B}$, $K_{31}$ and $K_{3n}$, respectively, the following two equations are valid;

$$\begin{aligned} I_1 &= K_{1A}(V_{gs1A} - V_{th1A})^2 \\ &= K_{1B}(V_{gs1B} - V_{th1B})^2 \end{aligned} \tag{11}$$

and $$V_1 = V_{gs1A} + V_{gs1B} \tag{12}$$

and

Here, if the variables are so set that $K_{1A} = K_{1B}$ and $V_{th1A} = V_{th1B}$ are valid, using Eq. (11), a relation $V_{gs1A} = V_{gs1B}$ can be obtained. Using this relation, Eq. (12) is transformed into;

$$\begin{aligned} V_2 &= V_{gs1B} \\ &= \frac{1}{2} V_1 \end{aligned} \tag{13}$$

On the other hand, since a relation $V_{gs1B} = V_{gs2B}$ is valid, the drain current $I_2$ of the FET $Q_{2B}$ is given by the following equation;

$$\begin{aligned} I_2 &= K_{2B}(V_{gs2B} - V_{th2B})^2 \\ &= K_{2B}\left(\frac{1}{2} V_1 - V_{th2B}\right)^2 \end{aligned} \tag{14}$$

Further, since this current $I_2$ flows also through the FET $Q_{2A}$, the following equation is valid;

$$I_2 = K_{2A}(V_{gs2A} - V_{th2A})^2 \tag{15}$$

Transforming Eq. (15), the following equation is obtained;

$$V_{gs2A} = \sqrt{\frac{I_2}{K_{2A}}} + V_{th2A} \tag{16}$$

On the other hand, since a relation $V_3 = V_1 - V_{gs2A}$ is valid, inserting Eqs. (14) and (15) in this relation, the following equation is obtained;

$$V_3 = V_1 - \sqrt{\frac{K_{2B}}{K_{2A}}\left(\frac{1}{2} V_1 - V_{th2B}\right)^2} - V_{th2A} \tag{17}$$

Here, if $K_{2B}$ and $K_{2A}$ are so set that $K_{2B}/K_{2A} = 4$, Eq. (17) can be transformed as represented by the following equation;

$$\begin{aligned} V_3 &= V_1 - (V_1 - 2V_{th2B}) - V_{th2A} \\ &= 2V_{th2B} - V_{th2A} \end{aligned} \tag{18}$$

and thus it is possible to obtain the constant voltage $V_3$, which is independent of variations in the power source $V_1$.

When FETs $Q_{2A}$ and $Q_{2B}$ are fabricated under same fabrication conditions, a relation $V_{th2A} = V_{th2B} = V_{TH}$ is obtained. When this relation is inserted into Eq. (18), it is transformed as indicated by the following equation and it is possible to take out the threshold voltage $V_{TH}$ therefrom. From this result it can be understood that this circuit is usable also as a threshold voltge detecting circuit;

$$V_3 = 2V_{TH} - V_{TH} = V_{TH} \tag{19}$$

On the other hand, when the drain current $I_{31}$ of the FET $Q_{31}$ is calculated by using Eq. (18), the following equation can be obtained;

$$\begin{aligned} I_{31} &= K_{31}(V_{gs31} - V_{th31})^2 \\ &= K_{31}(V_3 - V_{th31})^2 \\ &= K_{31}(2V_{th2B} - V_{th2A} - V_{th31})^2 \end{aligned} \tag{20}$$

Consequently, when the FETs $Q_{2A}$, $Q_{2B}$ and $Q_{31}$ are fabricated under same fabricating conditions, a relation $V_{th2A} = V_{th2B} = V_{th31} = V_{TH}$ is obtained.

After that, by implanting impurity ions in the channel portions of the FETs $Q_{2A}$ and $Q_{31}$, $V_{th2A} = V_{th31} = V_{TH} - \Delta V_{TH}$ is realized. This variation amount $\Delta V_{TH}$ is controlled with a high precision by controlling the amount of implanted ions. Inserting this condition in Eq. (20), the following equation is obtained;

$$\begin{aligned} I_{31} &= K_{31}(2V_{TH} - (V_{TH} - \Delta V_{TH}) - (V_{TH} - \Delta V_{TH}))^2 \\ &= K_{31}(2\Delta V_{TH})^2 \end{aligned} \tag{21}$$

Consequently it can be understood that a constant current $I_3$ set with a high precision is obtained by using Eq. (21).

On the other hand relations $V_{th2B} = V_{TH} + \Delta V_{TH}$ and $V_{2A} = V_{31} = V_{TH}$ are obtained by implanting impurity ions in the channel portion of the FET $Q_{2B}$ after having fabricated the FETs $Q_{2A}$, $Q_{2B}$ and $Q_{31}$ under same fabrication conditions. Inserting these relations in Eq. (20), the following equation is obtained;

$$\begin{aligned} I_{31} &= K_{31}(2(V_{TH} + \Delta V_{TH}) - V_{TH} - V_{TH})^2 \\ &= K_{31}(2\Delta V_{TH})^2 \end{aligned} \tag{22}$$

Further relations $V_{th2A} = V_{TH} - \Delta V_{TH}$ and $V_{th2B} = V_{th31} = V_{TH}$ are obtained by implanting impurity ions in the channel portion of the FET $Q_{2A}$ after having fabricated the FETs $Q_{2A}$, $Q_{2B}$ and $Q_{31}$ under same fabrication conditions. Inserting these relations in Eq. (20), the following equation is obtained;

$$\begin{aligned} I_{31} &= K_{31}(2V_{TH} - (V_{TH} - \Delta V_{TH}) - V_{TH})^2 \\ &= K_{31}(\Delta V_{TH})^2 \end{aligned} \tag{23}$$

Figure 3:
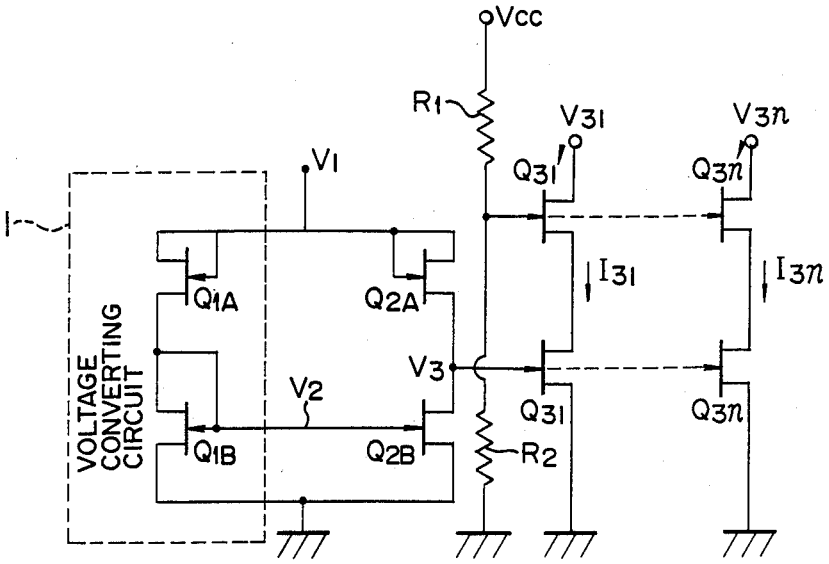
FIGS. 3 to 7 show circuit diagrams representing semiconductor circuits according to modified embodiments of this invention.

FIG. 3 indicates a modified embodiment, by which the following improvements are added to the embodiments indicated in FIG. 2.

That is, additional FETs $Q_{31}' - Q_{3n}'$ are connected with the constant current FETs $Q_{31} - Q_{3n}$ in FIG. 2, respectively, and the gates of these additional FETs $Q_{31}' - Q_{3n}'$ are biased with a voltage obtained by dividing the voltage $V_{cc}$ of the power source by means of resistances $R_1$ and $R_2$.

By this circuit connection indicated in FIG. 3 it is possible to reduce influences of the drain conductance on the constant current FETs $Q_{31} - Q_{3n}$. In this way no unnecessarily high voltage is applied to the drains of the FETs $Q_{31} - Q_{3n}$, even if the voltages $V_{31} - V_{3n}$ are high, and thus a result can be obtained that variations in the currents $I_{31}$-$I_{3n}$ are small.

Figure 4:
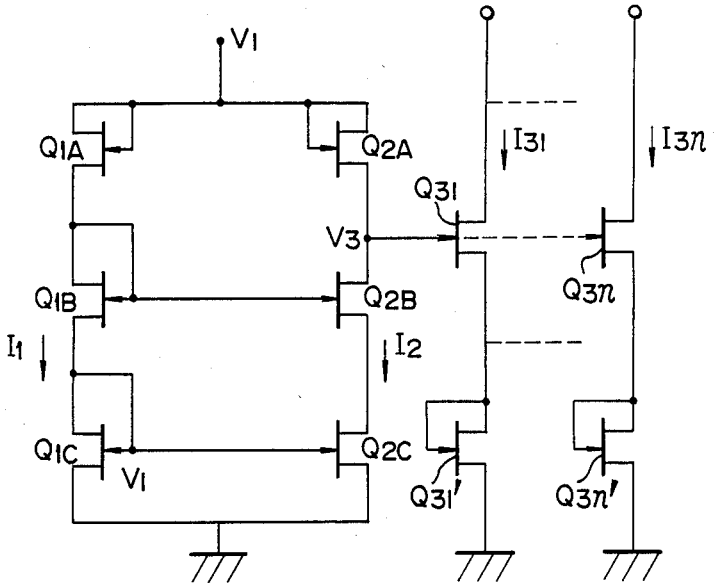

FIG. 4 indicates another modified embodiment, by which the following improvements are added to the embodiment indicated in FIG. 2.

That is, FETs $Q_{1C}$ and $Q_{31}' - Q_{3n}'$, whose gate and drain are short-circuited, and an FET $Q_{2C}$ are connected additionally therewith.

When an analysis similar to that described above is effected for the circuit indicated in FIG. 4, a conclusion described below can be obtained;

$$\begin{aligned} I_1 &= K_{1A}(V_{gs1A} - V_{th1A})^2 \\ &= K_{1B}(V_{gs1B} - V_{th1B})^2 \\ &= K_{1C}(V_{gs1C} - V_{th1C})^2 \end{aligned} \tag{24}$$

$$V_1 = V_{gs1A} + V_{gs1B} + V_{gs1C} \tag{25}$$

Here, if relations $K_{1A} = K_{1B} = K_{1C}$ and $V_{th1A} = V_{th1B} = V_{th1C}$ are realized, a relation $V_{gs1A} = V_{gs1B} = V_{gs1C}$ is obtained. By operations similar to those described above the following equations can be obtained;

$$V_2 = V_{gs1C} = \frac{1}{3} V_1 \tag{26}$$

$$I_2 = K_{2C}\left(\frac{1}{3} V_1 - V_{th2C}\right)^2 \tag{27}$$

$$I_2 = K_{2A}(V_{gs2A} - V_{th2A})^2 \tag{28}$$

$$V_{gs2A} = \sqrt{\frac{I_2}{K_{2A}}} + V_{th2A} \tag{29}$$

$$\begin{aligned} V_3 &= V_1 - V_{gs2a} \\ &= V_1 - \sqrt{\frac{K_{2C}}{K_{2A}}\left(\frac{1}{3} V_1 - V_{th2C}\right)^2} - V_{th2A} \end{aligned} \tag{30}$$

Here, if $K_{2C}$ and $K_{2A}$ are so set that $K_{2C}/K_{2A} = 9$ is fulfilled, Eq. (30) can be transformed as follows;

$$\begin{aligned} V_3 &= V_1 - (V_1 - 3V_{th2C}) - V_{th2A} \\ &= 3V_{th2C} - V_{th2A} \end{aligned} \tag{31}$$

On the other hand, the current flowing through the FETs $Q_{31}$ and $Q_{31}'$ is expressed as follows;

$$\begin{aligned} I_{31} &= K_{31}(V_{gs31} - V_{th31})^2 \\ &= K_{31}'(V_{gs31}' - V_{th31}')^2 \end{aligned} \tag{32}$$

If the parameters are so set that relations $K_{31} = K_{31}'$ and $V_{th31} = V_{th31}'$ are realized, a relation $V_{gs31} = V_{gs31}'$ is obtained by using Eq. (32). On the other hand, since there is a relation $V_3 = V_{gs31} + V_{gs31}'$, the following equation is obtained;

$$V_{gs31} = \frac{V_3}{2} \tag{33}$$

Consequently the following equation can be obtained by using Eqs. (31), (32) and (33);

$$\begin{aligned} I_{31} &= K_{31}\left(\frac{3V_{th2C} - V_{th2A}}{2} - V_{th31}\right)^2 \\ &= \frac{K_{31}(3V_{th2C} - V_{th2A} - 2V_{th31})^2}{4} \end{aligned} \tag{34}$$

In this way relations $V_{th2A}=V_{th31}=T_{TH}-\Delta V_{TH}$ and $V_{th2C}=V_{TH}$ are obtained by implanting impurity ions in the channel portions of the FETs $Q_{2A}$ and $Q_{31}$ after having fabricated the FETs $Q_{2C}$, $Q_{2A}$ and $Q_{31}$ under the same fabrication conditions. Inserting these relations in Eq. (34), the following equation is obtained;

$$\begin{aligned} I_{31} &= \frac{K_{31}(3V_{TH} - (V_{TH} - \Delta V_{TH}) - 2(V_{TH} - \Delta V_{TH})^2}{4} \\ &= \frac{K_{31}}{4}(3\Delta V_{TH})^2 \end{aligned} \tag{35}$$

Figure 5:
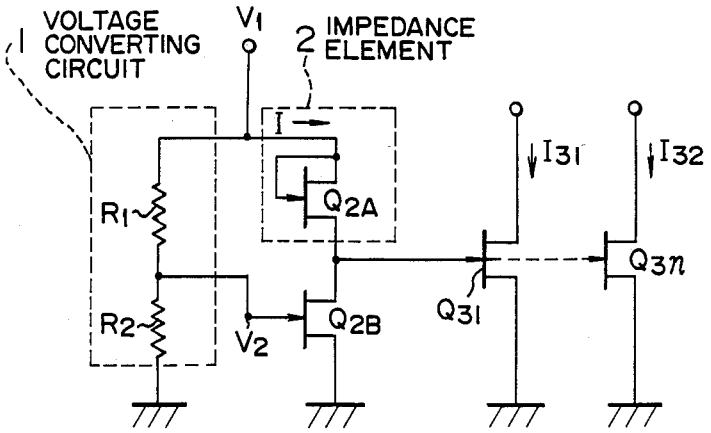

FIG. 5 indicates an embodiment, by which the following modification is added to the embodiment indicated in FIG. 2. That is, the FETs $Q_{1A}$ and $Q_{1B}$ in FIG. 2 are replaced by two resistances $R_1$ and $R_2$ in FIG. 5. If $R_1$ and $R_2$ are so set that $R_1=R_2$, Eq. (13) is satisfied and it is easily understood that the circuit indicated in FIG. 5 works in the manner completely identical to that described for FIG. 2.

Figure 6:
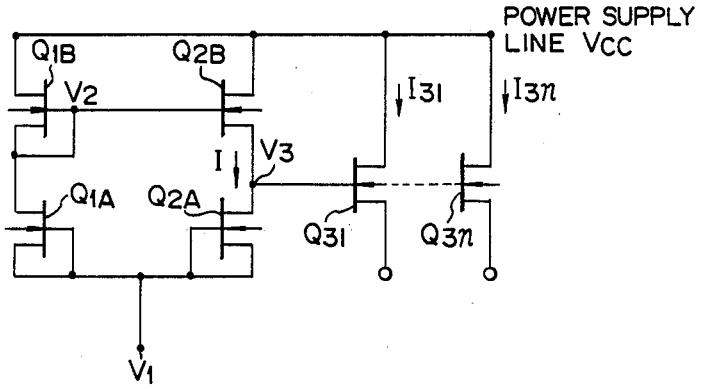

FIG. 6 indicates an embodiment, by which the N-channel FET in FIG. 2 is replaced by a P-channel FET. In this embodiment indicated in FIG. 6 the constant voltage is obtained between the power supply line $V_{cc}$ and the output $V_3$ and the constant current flows out from the drains of the FETs $Q_{31}-Q_{3n}$.

Figure 7:
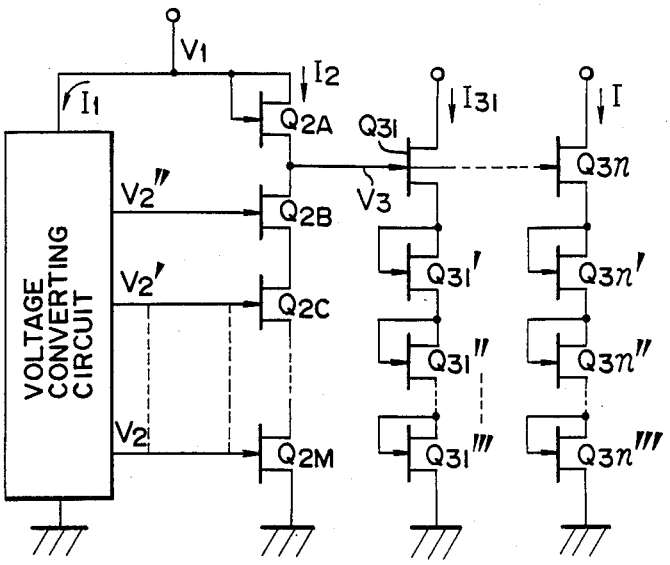

In the embodiment indicated in FIG. 7 the number of FETs connected in series in FIG. 4 is further increased and it is easily understood that the circuit indicated in FIG. 7 works in a manner similar to that described for FIG. 4.

Figure 8:
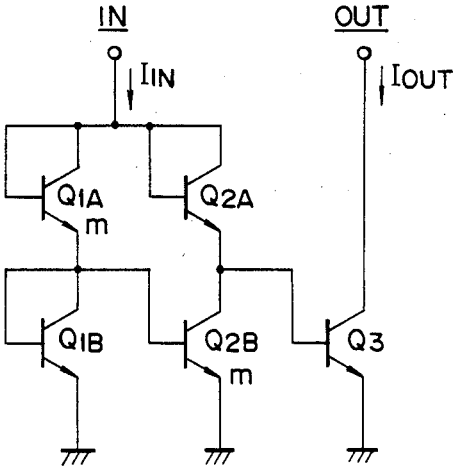
FIG. 8 (PRIOR ART)
FIG. 8 shows a circuit diagram representing a prior art current amplifier.

FIG. 8 is a circuit diagram illustrating the construction of the current amplifier disclosed in Japanese Patent Unexamined Publication No. 50-43870 corresponding to Japanese patent application claiming Conventional priority on the basis of U.S. patent application Ser. No. 381,175 filed July 20, 1973 and the form itself of the circuit connection has a good similarity with the embodiment of this invention indicated in FIG. 2, except that the circuit elements are bipolar transistors. The effective area of the base-emitter junction of the transistors $Q_{1A}$ and $Q_{2B}$ is so set that it is m times as large as that of the other transistors. Consequently the relationship between the input current $I_{IN}$ and the output current $I_{OUT}$ of this current amplifier can be represented by;

$$I_{OUT} = \frac{I_{IN}}{m^2 \cdot (m+1)}$$

and thus it differs from the operation of the constant voltage circuit or the constant current circuit according to this invention.

This invention is not restricted to the embodiments described above. For example junction type FETs, MOSFETs and further MESFETs (Metal Semiconductor Field Effect Transistor) can be used for the FETs.

As explained above, according to this invention, it is possible to realize a current source, whose output current is determined by the difference $\Delta V_{TH}$ between the K value and the threshold voltage of the transistors. Since these values are hardly influenced by variations in the power source voltage and the temperature, it is possible to realize a current source, whose output current value is not influenced by variations in the power source voltage and the temperature or fluctuations of the threshold voltage.

What is claimed is:

1. A semiconductor circuit comprising:

(1) a first means for generating a converted voltage at an output thereof, a first end thereof being connected with a first operating potential, a second end thereof being connected with a second operating potential, said converted voltage being obtained by attenuating or dividing a potential difference between said first operating potential and said second operating potential;

(2) an amplifying FET, having a gate, source and drain, the gate of which responds to said converted voltage of said first means and the source of which is connected to said second operating potential; and (3) load means, a first end thereof being connected to a drain of said amplifying FET, a second end thereof being connected with said first operating potential;

wherein said load means is another FET whose gate and drain are connected with said first operating potential and whose source is connected with said drain of said amplifying FET, wherein an attenuation or dividing ratio of said first means is set to a predetermined value, and wherein a ratio of a conductance of said amplifying FET to a conductance of said other FET is set to a value which is substantially equal to a square number of a reciprocal number of said predetermined value, whereby a voltage drop across said load means substantially cancels fluctuations of a voltage at said drain of said amplifying FET due to fluctuations in said potential difference.

2. A semiconductor circuit according to claim 1 further comprising:

(4) a constant current FET having a gate which responds to a voltage at said drain of said amplifying FET and having a source which is connected with said second operating potential, whereby a current maintained substantially constant flows through a drain-source path of said constant current FET.

3. A semiconductor circuit according to claim 2, wherein a threshold voltage of at least one of said amplifying FET, said constant current FET and said other FET is regulated by implanting impurity ions to a channel thereof.

4. A semiconductor circuit according to claim 3, further comprising:

(5) an additional FET having a gate, source and drain, the source thereof being connected with said drain of said constant current FET, the gate thereof being biased at a predetermined potential, said constant current flowing through the drain thereof.

* * * * *